United States Patent [19]

Hirschfield

[11] 4,121,824

[45] Oct. 24, 1978

[54] BASEBALL TRAINING GLOVE

[76] Inventor: Robert K. Hirschfield, 25 Maryland Ave., Freeport, N.Y. 11520

[21] Appl. No.: 762,313

[22] Filed: Jan. 25, 1977

[51] Int. Cl.[2] ..... A63B 71/02

[52] U.S. Cl. ..... 273/26 C; 2/19

[58] Field of Search ..... 273/26 R, 26 C, 81; 2/16, 17, 18, 20, 21, 158, 159, 161 A, 161 R, 160, 62; 128/17

[56] References Cited

U.S. PATENT DOCUMENTS

| | | | |
|---|---|---|---|
| 1,714,648 | 5/1929 | Walker | 2/161 |
| 1,797,116 | 3/1931 | Barden | 2/19 |
| 2,025,357 | 12/1935 | Pagan | 2/20 X |
| 3,141,173 | 7/1964 | Jackson et al. | 2/19 |
| 3,203,006 | 8/1965 | Shirley | 2/159 X |
| 3,300,787 | 1/1967 | Denkert | 2/19 |
| 3,606,614 | 9/1971 | Pimitroff | 2/159 |

*Primary Examiner*—Richard C. Pinkham

*Assistant Examiner*—T. Brown

*Attorney, Agent, or Firm*—Robert L. Sherman

[57] ABSTRACT

The invention concerns a partially inflexible device which may be worn as a glove by one attempting to increase his glove/hand reaction time proficiency in the baseball skills of catching, fielding and catch/throw agility. It also may be used by an instructor or coach in demonstrating or teaching those skills to players of any skill level. The glove has the palm portion thereof made inflexible whereby a user cannot flex the palm to catch a ball by squeezing it with his glove hand. Instead, the user is forced to use his free hand to trap a ball between the inflexible palm of the glove and the free hand. The inflexible palm portion of the glove can be integrally formed with the glove; it can be an insert, permanently secured into a pocket of the glove; or it can be an insert which can be easily inserted into and removed from a pocket of the glove.

11 Claims, 2 Drawing Figures

BASEBALL TRAINING GLOVE

SUMMARY OF THE INVENTION

Participation in the sport of baseball requires, as does participation in any physical activity involving the use of special techniques, the development of certain fundamental skills. Unless those fundamental skills become "second nature" to the player so that he executes them virtually automatically, and without hesitation or concentrated effort, his level of play will be curtailed.

This invention relates to improving one's skill in the baseball arts of fielding, catching and the combination of catch/throwing. As will be shown, by using the subject device, one automatically will practice the proper techniques of fielding ground balls, line drives and fly balls; of catching a ball thrown by another player and of catching and throwing a ball in one fluid motion.

A variety of situations arises during a baseball game where those techniques must be executed competently and quickly. To name but a few, an infielder must be able to field a ground ball and throw it without hesitation where the batter, or any baserunner for that matter, is running quickly; an outfielder must be able to catch a batted ball, whether in the air or after it bounces, and with a quick release throw to the appropriate base or to home plate; an infielder, usually the second baseman or shortstop, must be able to catch a thrown ball and quickly pivot and throw to effect a double play. A game may be won or lost depending on proper execution.

Accordingly, baseball players at all levels of skills continually practice in an effort to increase and advance their level of play. Correspondingly, instructors and coaches of players who range from elementary school-age children to professional ballplayers insist on the development and enhancement of certain fundamental skills through repeated practice of properly demonstrated techniques. Players and coaches alike have had a long felt need for a training device that would enable one to develop those skills while reducing, if not eliminating, the potentiality of developing "bad habits" or poor skills.

The subject invention, which satisfies the aforementioned long felt need, is a device that provides the necessary means to advance the skills of any player. It is worn as a glove; indeed, its outward appearance may be that of an ordinary baseball glove. However, the pocket (that portion of the glove which covers the player's palm) and the portion at least one-third of the way up each finger is made inflexible, though it may be shock absorbent. Accordingly, when a ball is hit or thrown to a player wearing the subject training device, he must cover the ball with his ungloved hand immediately upon the ball's making contact with the rigid pocket, or else the ball will not be caught. In that way the player is properly taught to catch the ball with "two hands", i.e., to cover the ball immediately upon contact. The preference for a "two handed" catch exists in virtually all situations — ground balls, line drives, fly balls and thrown balls. Naturally, there are exceptions to any rule, but they are just that, exceptions. Sound fundamental skills require that one be able to perform the basics in a proficient way, and then be able to adapt as extraordinary situations arise (e.g. where one must jump, lunge or stretch in order to reach a thrown or hit ball with one hand).

BRIEF DESCRIPTIONS OF THE SEVERAL VIEWS OF THE DRAWING

DETAILED DESCRIPTION

The following is a detailed description of the invention wherein reference is made to the several views shown in the accompanying drawing. The same element of the invention appearing in more than one view is designated by the same numeral.

Figure 1:
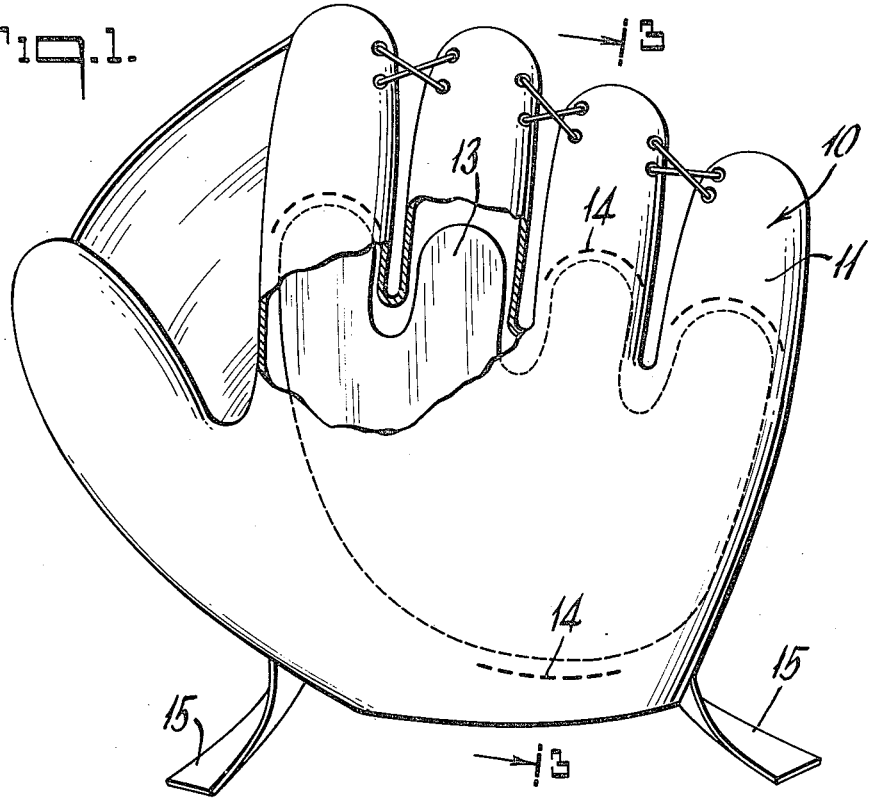
FIG. 1 is a general front view of the device encompassing the invention.

The baseball training device 10 constituting the invention is generally depicted in FIG. 1. As shown, it has the same overall configuration, saucer-like in shape, as an ordinary baseball glove. Indeed, the size, weight and general internal and external construction of the device should approximate, as closely as possible, that of a standard glove. In that way there will be a smoothe transition from using the subject device in practice to using a regular baseball glove under normal playing conditions.

Distinguishing the subject device from an ordinary glove is inflexible portion 13 which spans the entire pocket and extends at least one-third of the way up each of the fingers 11. It may extend up the entire finger portions if desired. Such construction prevents one who uses the device from catching a batted or thrown ball only with the gloved hand. The inflexibility of portion 13 would cause the ball to bounce off the training device unless the user quickly covered the ball with his ungloved hand. Of course, the fingers may be molded together instead of strung.

The inflexible portion 13 may be an integral part of device 10 or it may be pieced or inserted. If portion 13 is pieced or inserted into the device, it may be made of metal, plastic, rubber or any other natural or synthetic inflexible material. The remainder of the device, typically flexible, may be made of any well-known material used in manufacturing ordinary baseball gloves. If portion 13 is an integral part of the device, in addition to using any of the well-known materials already mentioned, it may be made of the same material of which the rest of the device is made and may be made inflexible merely by increasing its thickness relative to the rest of the device.

The device may be removably fastened to the hand by any well-known fastener 15. It may be belted, buckled or tied, or fastened by adhesive. Any means used to secure an ordinary baseball glove may be used to secure the subject device.

Figure 2:
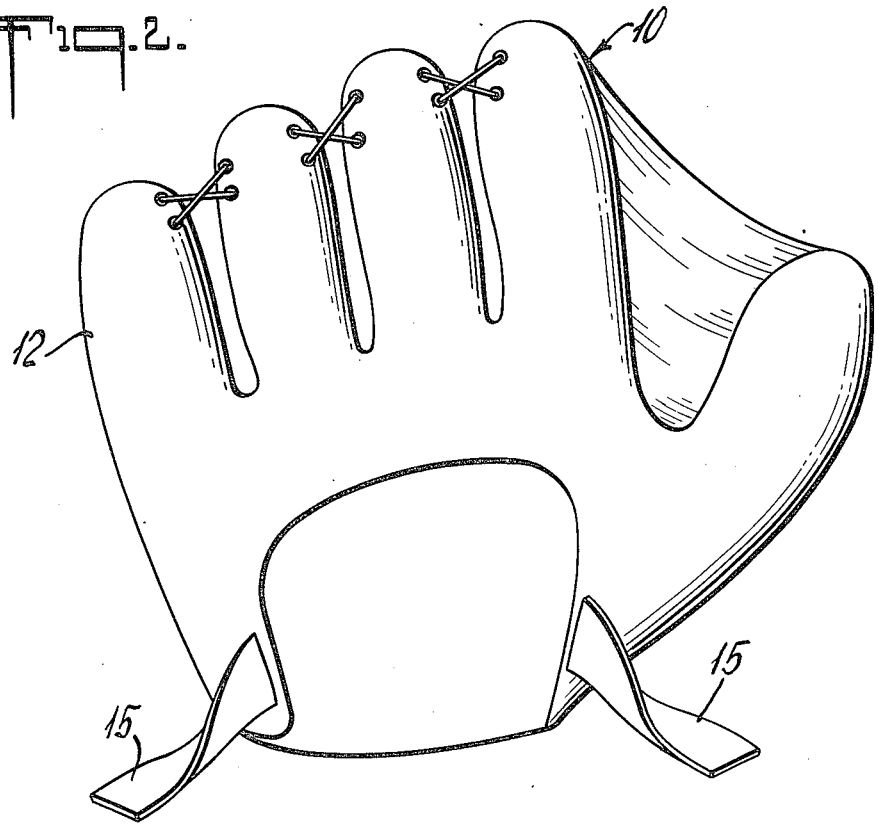
FIG. 2 is a rear view of the device encompassing the invention.

The rear portion of the device, shown in FIG. 2, has the same configuration as a baseball glove. The rear portion of the device 12 may be made of the same material used in making the flexible portion of the front of the device. That is, any well-known material used in the manufacture of ordinary baseball gloves may be used.

Figure 3:
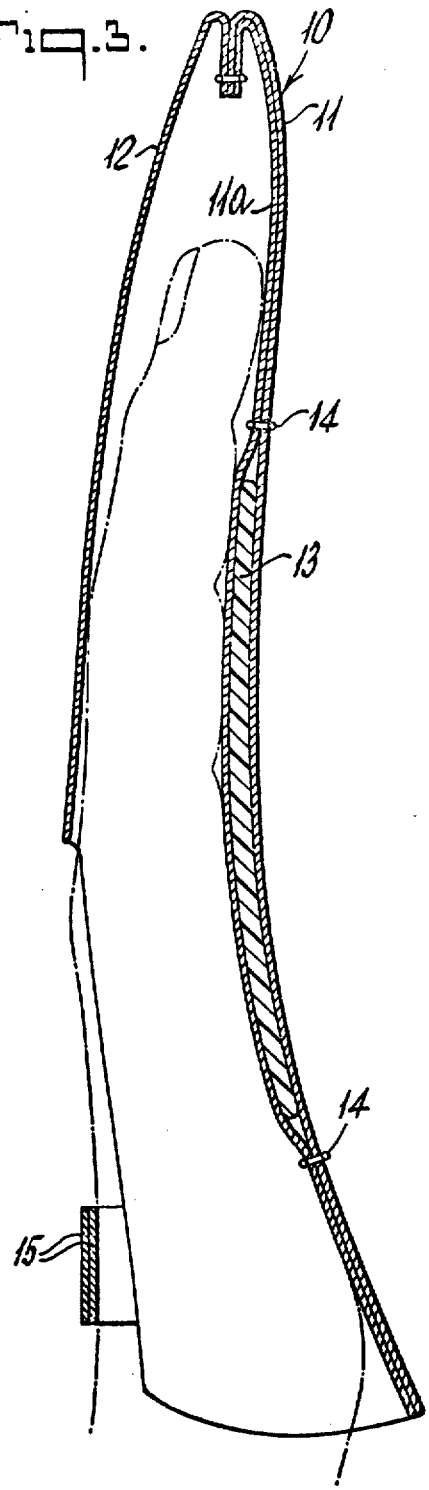
FIG. 3 is a sectional view taken along the plane 3—3 of FIG. 1 in the direction indicated.

The sectional view of FIG. 3 demonstrates the relationship of the subject device to the user's hand. As already noted, the inflexible portion 13 extends at least one-third of the way up the finger portion of the device.

Figure 4:
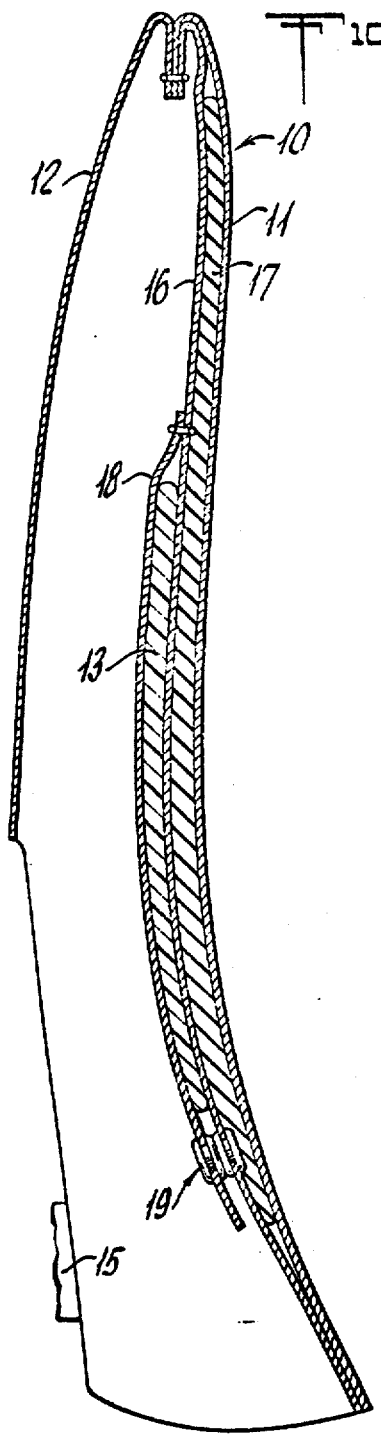
FIG. 4 is a sectional view of a slightly modified embodiment of the invention taken along the plane 3—3 of FIG. 1 in the direction indicated.

Thus, the user is prevented from simply bending his fingers in order to catch a ball one-handed. When portion 13 is pieced or inserted, it is retained between the lining 11*a* and the front exterior of the device by stitching, sealing or other retention means 14.

Where inflexible portion 13 is removable, FIG. 4, it may be held in place by any well-known temporary retention means, for example, snap 19. Additional padding 17 to increase shock absorbency may be provided between lining 16 and the front exterior of the device. In that case inflexible portion 13 would be retained between linings 16 and 18.

Naturally, the device may be made for and used by left-handed or right-handed players. It also may be adapted to resemble the configuration of first basemen's and catchers' mitts and gloves for any other position. It also may appear as a six-fingered glove instead of having the traditional web. Air holes or perforations may be provided throughout the device to provide ventilation for the gloved hand.

I claim as my invention:

1. A baseball training device to be worn on a hand of a user comprising a palm portion connected to a thumb portion and four finger portions, a web extending between said thumb portion and the nearest of said finger portions, wherein said palm portion is made of inflexible material which extends at least one-third of the way up each of the finger portions and substantially covers the entire palm of the hand of a user when said device is in use, and fastening means for removably securing said device to a hand of a user, and whereby said device prevents said user from catching a ball only with the hand on which the device is worn.

2. The baseball training device of claim 1 wherein portions of each of said finger portions are flexible.

3. The baseball training device of claim 1 wherein said inflexible material is an integral part of said device.

4. The baseball training device of claim 3 wherein said device is made plastic.

5. The baseball training device of claim 1 wherein said inflexible material is inserted into and permanently enclosed in a pocket, said pocket extending substantially over said palm portion of said device.

6. The baseball training device of claim 5 wherein said inflexible material is metal.

7. The baseball training device of claim 1 wherein said inflexible material is easily removable from a pocket which extends substantially over said palm portion of said device.

8. The baseball training device of claim 7 wherein said inflexible material is rubber.

9. The baseball training device of claim 7 wherein snap means are provided for securing and removing said inflexible material.

10. The baseball training device of claim 1 wherein said fastening means is a strap.

11. The baseball training device of claim 1 wherein said inflexible material extends into the full length of each finger portion.

* * * * *

UNITED STATES PATENT OFFICE

CERTIFICATE OF CORRECTION

Patent No. 4,121,824 Dated October 24, 1978

Inventor(s) Robert K. Hirschfield

It is certified that error appears in the above-identified patent and that said Letters Patent are hereby corrected as shown below:

The attached Figures 3 and 4 should be inserted.

Claim 4, line 2, after "made" insert -- of --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*